US006280158B1

(12) United States Patent
Itoh et al.

(10) Patent No.: US 6,280,158 B1
(45) Date of Patent: Aug. 28, 2001

(54) WATER PUMP FOR CIRCULATING COOLING WATER IN AN INTERNAL COMBUSTION ENGINE AND CAMSHAFT MOUNTING STRUCTURE THEREFOR

(75) Inventors: Katsuhiko Itoh; Yoshihiro Kimura; Takashi Shichinohe; Yasushi Fujimoto, all of Saitama (JP)

(73) Assignee: Honda Giken Kogyo Kabushiki Kaisha, Tokyo (JP)

( * ) Notice: Subject to any disclaimer, the term of this patent is extended or adjusted under 35 U.S.C. 154(b) by 0 days.

(21) Appl. No.: 09/487,545

(22) Filed: Jan. 19, 2000

(30) Foreign Application Priority Data

Jan. 19, 1999 (JP) ..... 11-010398
Jan. 27, 1999 (JP) ..... 11-019099

(51) Int. Cl.[7] ..... F04B 17/00
(52) U.S. Cl. ..... 417/423.8
(58) Field of Search ..... 417/423.8; 123/41.1, 123/41.17, 41.14

(56) References Cited

U.S. PATENT DOCUMENTS 4,662,320 * 5/1987 Moriya ..... 123/41.14
4,917,052 * 4/1990 Eguchi et al. ..... 123/41.17
5,715,776 * 2/1998 Seidl ..... 123/41.1

FOREIGN PATENT DOCUMENTS 63-125139 U 8/1988 (JP) .
B2278548 5/1998 (JP) .

* cited by examiner

*Primary Examiner*—Teresa Walberg
*Assistant Examiner*—Vinod D. Patel
(74) *Attorney, Agent, or Firm*—Birch, Stewart, Kolasch & Birch, LLP

(57) ABSTRACT

A water pump for circulating the cooling water of an internal combustion engine, facilitates the formation of the water passage connecting the water pump to the cooling water passage in the cylinder block and can reduce manufacturing costs thereof. A water pump for circulating the cooling water of an internal combustion engine is connected to one end of a cam shaft for a valve system arranged in a cylinder head and is driven by the cam shaft. A delivery port of the water pump is extended near to a cooling water supply port formed in the side wall of a cylinder block and is connected to a cooling water passage in the cylinder block. The delivery poll of the water pump is extended to a position directly opposite to the cooling water supply port, and is connected to the cooling water supply port with a connection pipe. A mounting structure of a camshaft is capable of applying high speed rotation by shortening a length of push rods and also capable of facilitating maintenance such as replacement of cams. In an overhead valve type internal combustion engine, a camshaft is located and mounted in space surrounded by an upper portion of a cylinder and cylinder head.

18 Claims, 8 Drawing Sheets

WATER PUMP FOR CIRCULATING COOLING WATER IN AN INTERNAL COMBUSTION ENGINE AND CAMSHAFT MOUNTING STRUCTURE THEREFOR

BACKGROUND OF THE INVENTION

1. Field of the Invention

The present invention relates to a water pump for circulating the cooling water of an internal combustion engine. In particular, the present invention relates to a water pump for circulating the cooling water of an internal combustion engine which includes a water passage for connecting a water pump which is connected to one end of and driven by a cam shaft for a valve system arranged in a cylinder head to a cooling water passage in a cylinder block. With this arrangement, manufacturing costs can be reduced.

The present invention also relates to a mounting structure of a camshaft in an overhead valve (OHV) type internal combustion engine.

2. Description of Related Art

A conventional water pump for circulating cooling water of an internal combustion engine is known from Japanese Patent Publication No. 2,782,548, wherein the water pump is mounted on a cylinder head body and a water passage communicating with a delivery port of the water pump is formed in a cylinder head. Furthermore, the water passage communicates with a cooling water passage (water jacket) in a cylinder block to introduce cooling water into the cooling water passage.

In addition, a conventional water pump for circulating the cooling water of an internal combustion engine is known, wherein instead of foaming the water passage communicating with the delivery port of the water pump in the cylinder head, a hose communicating with the cooling water passage in the cylinder block is used to introduce cooling water into the cooling water passage.

However, in the conventional water pump for circulating the cooling water of an internal conventional engine, the water passage needs to be formed in a cylinder head so as to make the delivery plot of the water pump communicate with the cooling water passage in the cylinder block. In the case where a hose is used instead of the water passage, the procedure of connecting the hose is troublesome. This results in an increase in the number of foaming processes and the number of assembling processes in both cases.

Conventionally, in an overhead valve type internal combustion engine, push rods having a long size are interposed between a camshaft which is close to a crank shaft and rocker arms for driving valves in order to transmit rotation of the crank shaft to open and close the valves disposed at an upper portion of a cylinder.

However, the push rods are not suitable for high speed rotation because of is heavy initial weights.

There is an example where the camshaft is separated away from the crank shaft so as to a-range the cam shaft in a central portion of a cylinder block (Japanese Unexamined Patent Publication No. Sho 63-125139).

The overhead valve type internal combustion engine 01 of the example described above is illustrated in FIG. 8 of the present invention. A camshaft 015 is installed in the central portion of a cylinder block 03 interposed between a crank case 02 and a cylinder head 04. Furthermore, a cam chain 018 is suspended between a cam sprocket 017 of the camshaft 015 and a timing sprocket 016 of a crank shaft 08.

Push rods 024 brought into contact, at their lower ends, with cam followers 020 which rock by coming into contact with cam surfaces of the camshaft are extended upward, penetrate the cylinder head 04, and reach a cylinder head cover 05, whereby upper ends of the push rods rock the rocker arms.

Accordingly, when reciprocating motion of a piston 06 rotates the crank shaft 08 via a connecting rod 07, the camshaft 015 within the cylinder block 03 is rotated via the cam chain 018 and the cam followers 020 are rocked. The rocking motion of the cam followers 020 moves the push rods 024 up and down, and opens and closes the valves at prescribed timings via the rocker arms.

In the example stated above, the cam shaft 015 is located within the cylinder block 03 so as to come closer to the rocker arms disposed on the upper side than in the case of the general overhead valve type internal combustion engine where the camshaft is located within the crank case, to thereby shorten the lengths of the push rods 024.

Therefore, the inertial weights of the push rods 024 are smaller than those of the general type engine, so that the mounting structure for the camshaft illustrated in the example is applicable to a certain degree of high speed rotation.

However, the push rods 024 still have a long size, since the push rods 024 penetrate the cylindrical head 04 and lower ends thereof reach the vicinities of the central portions of the cylinder block 03. Therefore, the inertial weights of this type of the push rods 024 remarkably influence on high speed rotation.

Furthermore, since the camshaft 015 is disposed at the central portion within the cylinder block 03, in the case where the cams are required to be replaced due to maintenance or the like, the cylinder block 03 must be removed on account of the necessity of removing the cam chain, and therefore it is not easy to replace the cams.

SUMMARY OF THE INVENTION

It is the object of the present invention to provide a water pump for circulating the cooling water of an internal combustion engine which can solve the above described problems of the conventional water pump. Specifically, it is an object of the present invention to provide a water pump which can facilitate the formation of the water passage connecting the water pump to the cooling water passage in the cylinder block and which can reduce manufacturing costs.

The present invention relates to a water pump for circulating the cooling water of an internal combustion engine which can solve the problems described above. According to a first aspect of the present invention, a water pump for circulating the cooling water of an internal combustion engine is connected to one end of a cam shaft for a valve system arranged in a cylinder head. The water pump is driven by the cam shaft and the delivery port of the water pump is extended near a cooling water supply port formed in the side wall of a cylinder block and is connected to a cooling water passage in the cylinder block.

The first aspect of the present invention is constituted in a manner described above, and the delivery port of the water pump which is connected to one end of a cam shaft for a valve system and is driven by the cam shaft is extended near to a cooling water supply port formed in the side wall of the cylinder block and is connected to the cooling water supply port.

As a result, the number of processes for foaming a water passage for connecting the water pump to the cooling water passage in the cylinder block and the number of assembling processes can be reduced. Furthermore, piping such as a hose for connecting the delivery port of the water pump to the cooling water supply port formed in the side wall of the cylinder block can be reduced to a minimum. This can facilitate the formation of the water passage for connecting the water pump to the cooling water passage in the cylinder block and can reduce manufacturing costs.

In addition to the first aspect of the present invention, the present invention according to a second aspect includes the delivery port of the water pump extended to a position directly opposite to the cooling water supply port formed in the side wall of the cylinder block and the delivery port is connected to the cooling water supply port with a connection pipe.

As a result, the delivery port of the water pump can be connected to the cooling water supply port formed in the side wall of the cylinder block with a short straight pipe, which can simplify the connection structure thereof.

It is also an object of the present invention to provide a mounting structure of the camshaft which is capable of applying the structure to high speed rotation by shortening the lengths of the push rods as well as facilitating maintenance such as the replacement of the cams.

In order to achieve the object mentioned above, an overhead valve type internal combustion engine includes the camshaft located and mounted in a space surrounded by an upper portion of a cylinder and a cylinder head.

Since the camshaft is mounted in the space surrounded by the upper portion of the cylinder and the cylinder head, the push rods connecting the interval between the cam followers and the rocker arms which are provided within the cylinder cover can be set short so as to reduce the inertial weights thereof, hence enabling application for the high speed rotation.

Furthermore, in the case of carrying out the maintenance operation such as replacing the cams, only the cylinder head is required to be removed, while leaving the cylinder block as it is. The cam chain is easily removed to facilitate the replacement of the cams.

In the mounting structure of the camshaft according to the present invention, the camshaft is located and mounted upward from the cylinder deck surface.

The camshaft is located within the cylinder head, the lengths of the push rods connecting the intervals between the rocker arms and the cam followers become short so as to be capable of high speed rotation. Furthermore, since the camshaft is exposed when the cylinder head is removed, maintenance such as the replacement of the cams becomes simplified.

In the mounting structure of the camshaft according to the present invention, an opposed pair of mounting bolts of the camshaft holders pivotally supporting the camshaft are positioned in an offset relationship with each other in an axial direction.

The camshaft is pivotally supported by the camshaft holders via bearings and at least the mounting bolts on one side can be arranged in the vicinity of the camshaft by avoiding the interference with the bearings, thus enabling the widths in the diametrical direction to be narrow. Therefore, compact mounting of the camshaft can be attained.

Further scope of applicability of the present invention will become apparent from the detailed description given hereinafter. However, it should be understood that the detailed description and specific examples, while indicating preferred embodiments of the invention, are given by way of illustration only, since various changes and modifications within the spirit and scope of the invention will become apparent to those skilled in the amount from this detailed description.

BRIEF DESCRIPTION OF THE DRAWINGS

The present invention will become more fully understood from the detailed description given hereinbelow and the accompanying drawings which are given by way of illustration only, and thus are not limitative of the present invention, and wherein.

DETAILED DESCRIPTION OF THE PREFERRED EMBODIMENTS

The first and second aspects of the present invention will now be described with reference to FIGS. 1–3.

Figure 1:
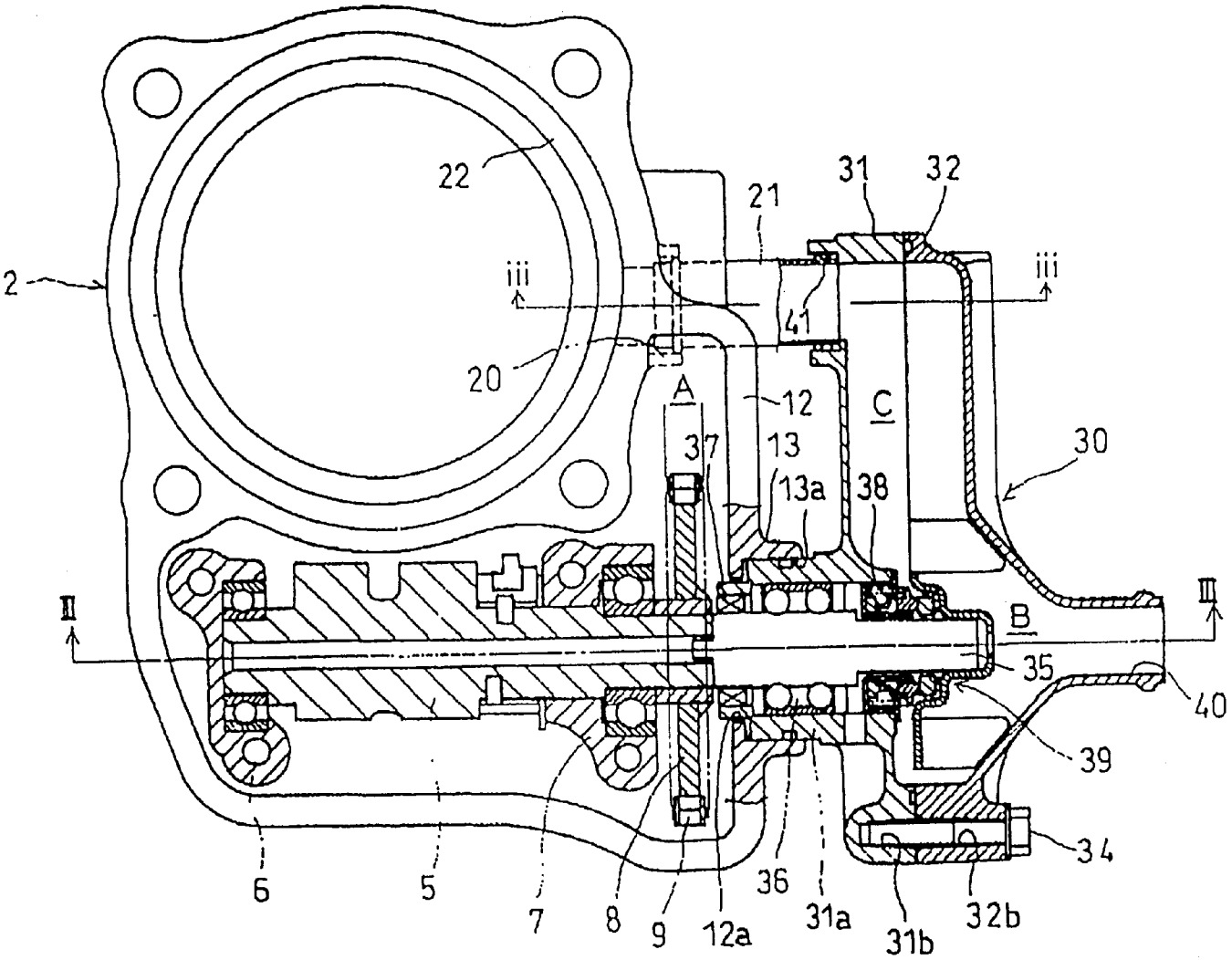
FIG. 1 is an illustration showing in combination a plan view obtained by dividing an internal combustion engine at the position of the mating faces of a cylinder block and a cylinder head, and a cross-sectional view obtained by dividing only a cam shaft for a valve system and the water pump for circulating cooling water by a plane passing the shaft thereof.

FIG. 1 is an illustration showing in combination a plan view obtained by dividing an internal combustion engine, to which a water pump for circulating cooling water in the embodiment in accordance with the present invention is applied, at the position of the mating faces of a cylinder block and a cylinder head, and a cross-sectional view obtained by dividing only a cam shaft for a valve system and the water pump for circulating cooling water by a plane passing the shaft thereof. FIG. 2 is a partial schematic right side view of the internal combustion engine when viewed from the right side in FIG. 1.

Figure 3:
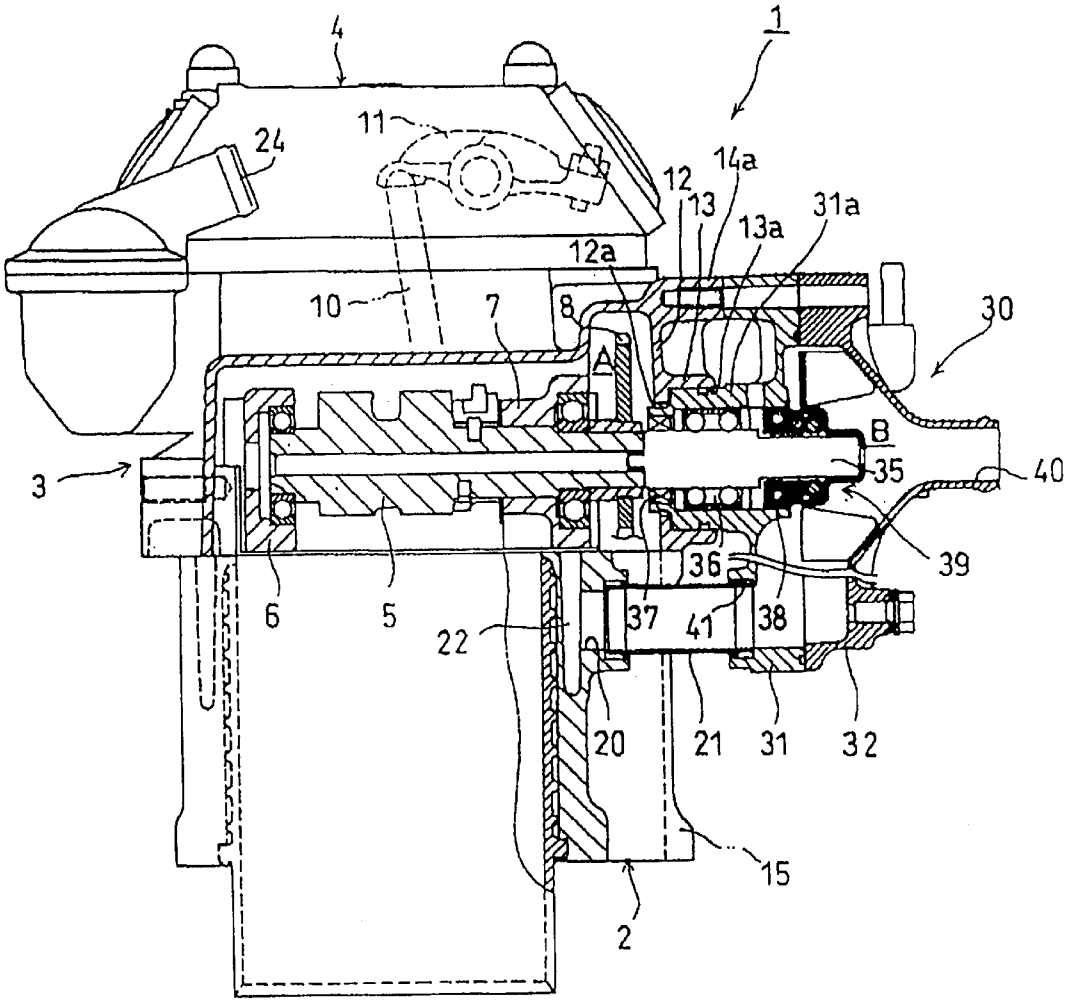
FIG. 3 is an illustration showing in combination a longitudinal cross-sectional view taken on a line III—III shown by arrows in FIG. 1 and a longitudinal cross-sectional view taken on a line iii—iii shown by arrows in FIG. 1.

FIG. 3 is an illustration showing in combination a longitudinal cross-sectional view taken on a line III—III shown by allows in FIG. 1 and a longitudinal cross-sectional view taken on a line iii—iii shown by allows in FIG. 1.

As shown in these drawings, an internal combustion engine 1 to which a water pump 30 for circulating cooling water in the present embodiment is applied is an overhead-valve-type internal combustion engine in which a cam shaft 5 for a valve system is held by cam shaft holders 6, 7 in a cylinder head 3 and is arranged in the cylinder head 3 to open or close a suction valve and an exhaust valve (both not shown) which are arranged above a cylinder block 2. A cylinder head cover 4 is capped on the top f the cylinder head 3.

The cam shaft 5 is rotated by a timing chain 9 looped around a drive sprocket fixed to a crank shaft (not shown) and a driven sprocket 8 fixed to one end of the cam shaft 5 to move up and down the bottom end of a push rod 10 (see FIG. 3) abutting on the cam surface of the cam shaft 5 and then to oscillate a rocker arm 11 by the top end of the push rod 10, whereby the suction valve and the exhaust valve are opened or closed at a desired timing.

The timing chain 9 is guided by a chain guide 16 and is pressed in the direction of tension by a shoe 17 and suitable tension is always applied thereto. The shoe 17 is pressed by the plunger 19 of a hydraulic tensioner 18. In this respect, a reference numeral 23 designates the connection port for connecting an exhaust manifold.

An annular projecting wall 13 and a round projecting boss-shaped seat 14*a* for mounting the water pump 30 for circulating cooling water are formed on the outside wall 12 of the cylinder head 3 side forming a timing chain chamber A which receives the timing chain 9.

A circular hole 13*a* for receiving the cylindrical mounting portion 31*a* of the inside casing 31 of the water pump 30 is formed in the annular projecting wall 13. The top end portion of the water pump 30, in FIG. 2, is integrally mounted on the seat 14*a* with a bolt (not shown) passing through the inside casing 31 and an outside casing 32 (see FIG. 3) The bolt is screwed into a threaded hole formed in the seat 14*a*.

Figure 2:
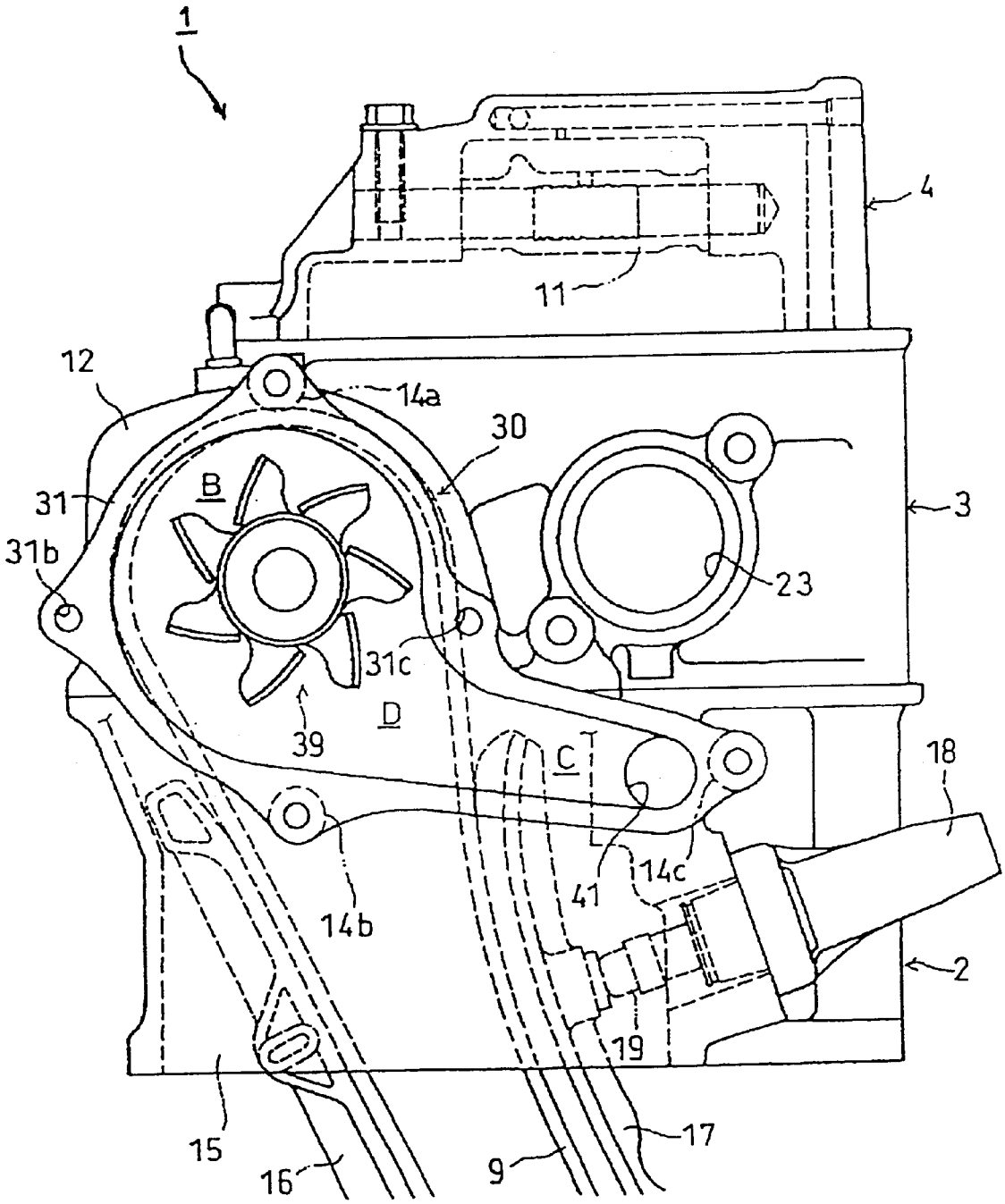
FIG. 2 is a partial schematic right side view of the internal combustion engine of the present invention when viewed from the right side in FIG. 1.

Seats 14*b*, 14*c* shaped like the seat 14a for mounting the water pump 30 are formed in a projecting shape on the outside wall 15 of the cylinder block 2 side forming the timing chain chamber A receiving the timing chain 9 (see FIG. 2).

As is the case where the top end portion of the water pump 30 is integrally mounted on the seat 14*a*, a position directly below the top end portion of the water pump 30 is mounted on the seat 14*b* with a bolt and the tip end of a portion forming a delivery chamber C communicating with the pump chamber B of the water pump 30 is integrally mounted on the seat 14*c* with a bolt.

The water pump 30, therefore, is mounted on and held by the cylinder head 3 and the cylinder block 2 at three positions of the top end portion of the water pump 30, the portion directly below the top end portion of the water pump 30, and the tip end of the portion forming the delivery chamber C.

Furthermore, a bolt 34 is passed through a bolt hole 32*b* made in the outside casing 32 and is screwed into the threaded bolt hole 31*b* formed in the inside casing 31 at the left central position between the seat 14*a* and the seat 14*b*, in FIG. 2, on which the water pump 30 is integrally mounted with bolts, to integrally fasten the inside casing 31 and the outside casing 32 of the water pump 30 to each other (see FIG. 1 and FIG. 2).

Similarly, a bolt 34 is passed through a bolt hole 32*c* (not shown) made in the outside casing 32 and is screwed into the threaded bolt hole 31*c* formed in the inside casing 31 at the right central position between the seat 14*a* and the seat 14*c*, in FIG. 2, on which the water pump 30 is integrally mounted with bolts, to integrally fasten the inside casing 31 and the outside casing 32 of the water pump 30 to each other.

Therefore, the inside casing 31 and the outside casing 32 of the water pump 30 are integrally fastened to each other with bolts at five positions of the seats 14*a*, 14*b*, 14*c* on which the water pump 30 is integrally mounted and threaded bolt holes 31*b*, 31*c* made in the inside casing 31.

The cylindrical mounting portion 31*a* of the inside casing 31 of the water pump 30 is formed in a step-wise shape including a portion with a large diameter and a portion with a small diameter. The portion with the large diameter is fitted into the circular hole 13*a* of the annular projecting wall 13 of the outside wall 12 and the portion with the small diameter is loosely passed with an allowance through a hole 12*a* made through the bottom wall of the circular hole 13*a*.

The rotary shaft 35 of the water pump 30 is passed through the inside of the cylindrical mounting portion 31*a* and is journalled by a ball bearing 36. In FIG. 1, the left end portion of the rotary shaft 35 is sealed with a sealing member 37 and a tip end thereof is projected into the timing chain chamber A from the outside wall 12 and is fitted in one end of the cam shaft 5.

In FIG. 1, the right end portion of the rotary shaft 35 is sealed with a sealing member 38 and the tip end thereof is projected into the pump chamber B and the impeller 39 of the water pump 30 is fitted thereon.

A pump suction port 40 is made in the outside casing 32 in front of the right side tip end portion of the rotary shaft 35 and a pump delivery port 41 is made in the inside casing 31 at the position corresponding to the tip end portion of the delivery chamber C communicating with the pump chamber B.

The casing of the water pump 30 made by the inside casing 31 and the outside casing 32, as described above, forms the pump chamber B and the delivery chamber C and spreads over the cylinder head 3 and the cylinder block 2 and is fastened to the cylinder head 3 and the cylinder block 2 with bolts. The casing of the water pump 30 when viewed from the side, as is evident from FIG. 2, has smooth integral contours in which the circular contour of a portion forming the pump chamber B is smoothly integrated with the slender contour of a portion forming the delivery chamber C. The smooth integral contour is tapered toward the delivery port 41 at the delivery poll portion D of the pump chamber B which is formed by cutting away a part of the circular arc of the pump chamber B.

The slender contour of the portion forming the delivery chamber C and tapered toward the delivery port 41 extends from the circular portion forming the pump chamber B toward the cylinder block 2 which is arranged slantwise below the pump chamber B, and has a curved shape like a funnel as a whole.

In this connection, the delivery port 41 of the water pump 30 extends to a position directly opposite to a cooling water supply port 20 made in the side wall of the cylinder block 2. A short straight connection pipe 21 is fitted between the delivery plot 41 and the cooling water supply port 20, whereby the delivery port 41 is connected to the cooling water supply port 20.

Therefore, the cooling water sucked from the pump suction port 40 of the cylinder head 3 side is pressurized by the water pump 30 and is delivered from the pump chamber B into the delivery chamber C forming the water passage of the cylinder block 2 side. The cooling water flows into a cooling water passage (water jacket) 22 in the cylinder block 2 through the delivery port 41 connected to the tip end portion of the delivery chamber C, the connection pipe 21, and the cooling water supply port 20. Furthermore, the cooling water flows in the cooling passage (not shown) in the cylinder head 3 to cool the cylinder block 2 and the cylinder head 3. Then, the cooling water which has an elevated temperature is returned to a radiator (not shown) from an outlet 24 (see FIG. 3). One end of a hose connected to the radiator is connected to the outlet 24.

Since the present embodiment is constituted in a manner described above, it can produce the following effects.

The delivery port 41 of the water pump 30 connected to one end of the cam shaft 5 for a valve system and driven by the cam shaft 5 is extended to the position directly opposite to the cooling water supply port 20 made in the side wall of the cylinder block 2 and is connected to the cooling water passage 22 in the cylinder block 2.

As a result, the major portion of a water passage connecting the water pump 30 to the cooling water passage 22 in the cylinder block 2 is formed at a time by the delivery chamber C integrally formed with the water pump 30 and the delivery port 41 connected to the tip end of the delivery chamber C. Accordingly, this results in reducing the number of forming processes and the number of assembling processes required for forming the water passage and in facilitating the formation thereof.

A piping like a hose for connecting the delivery port 41 of the water pump 30 to the cooling water supply port 20 formed in the side wall of the cylinder block 2 can be reduced to a minimum. That is, the delivery port 41 is connected to the cooling water supply port 20 only by the connection pipe 21 which is made of only a short straight pipe. This can simplify the connecting structure between the ports 41 and 20 and hence can further facilitate the formation of the water passage for connecting the water pump 30 to the cooling water passage 22 in the cylinder block 2.

The mounting structure of the camshaft according to the present invention will now be described in detail with reference to FIGS. 4–7.

An overhead type internal combustion engine 101 relating to the embodiment of the present invention includes a cylinder block 103, a cylinder head 104, and a cylinder head cover 105 sequentially overlapped on a crank case 102 and integrally associated with each other.

Figure 4:
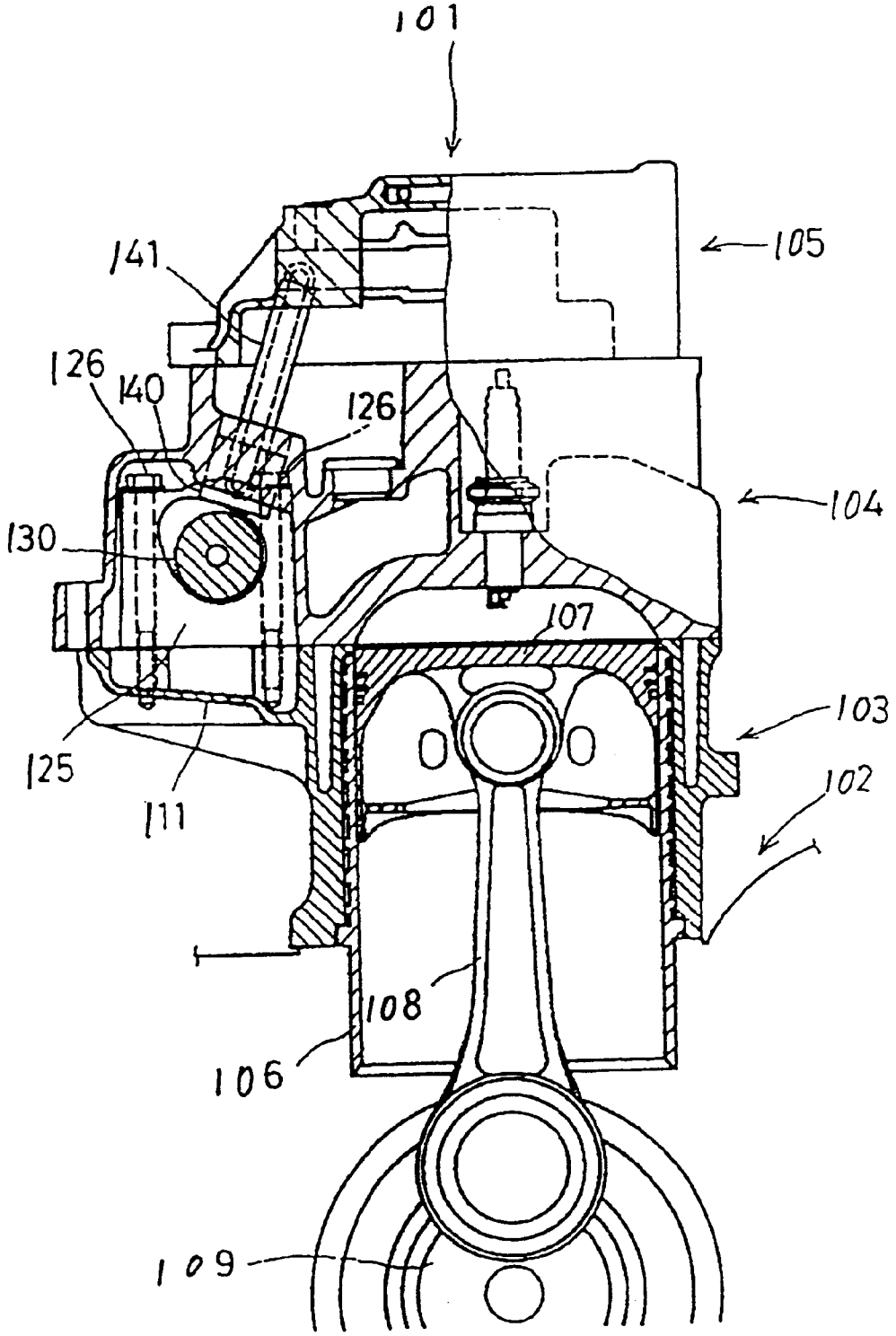
FIG. 4 is an elevational view partially in section illustrating an overhead valve type internal combustion engine relating to an embodiment of the present invention.
Figure 5:
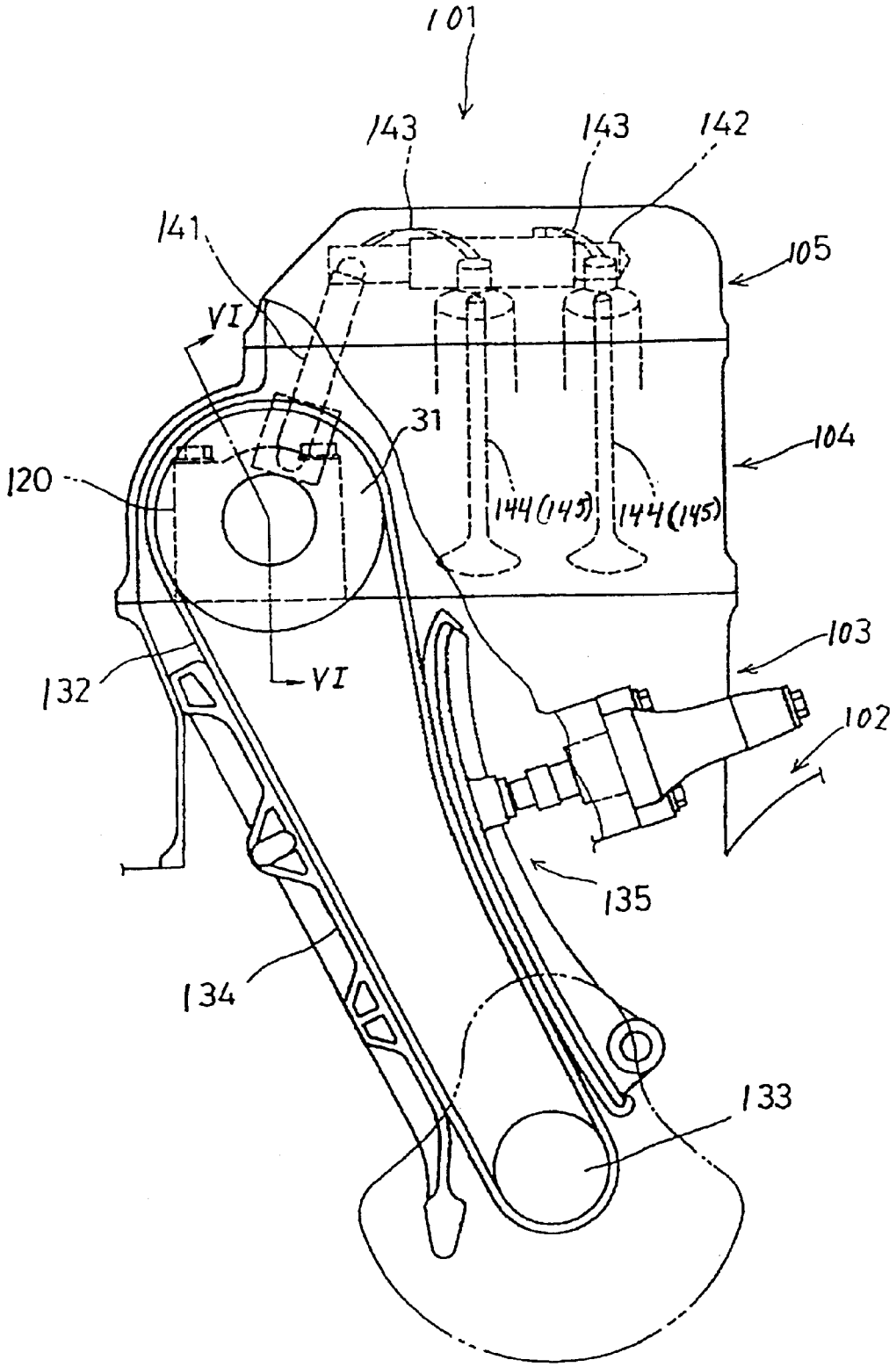
FIG. 5 is an elevational view partially in cutaway thereof.
Figure 6:
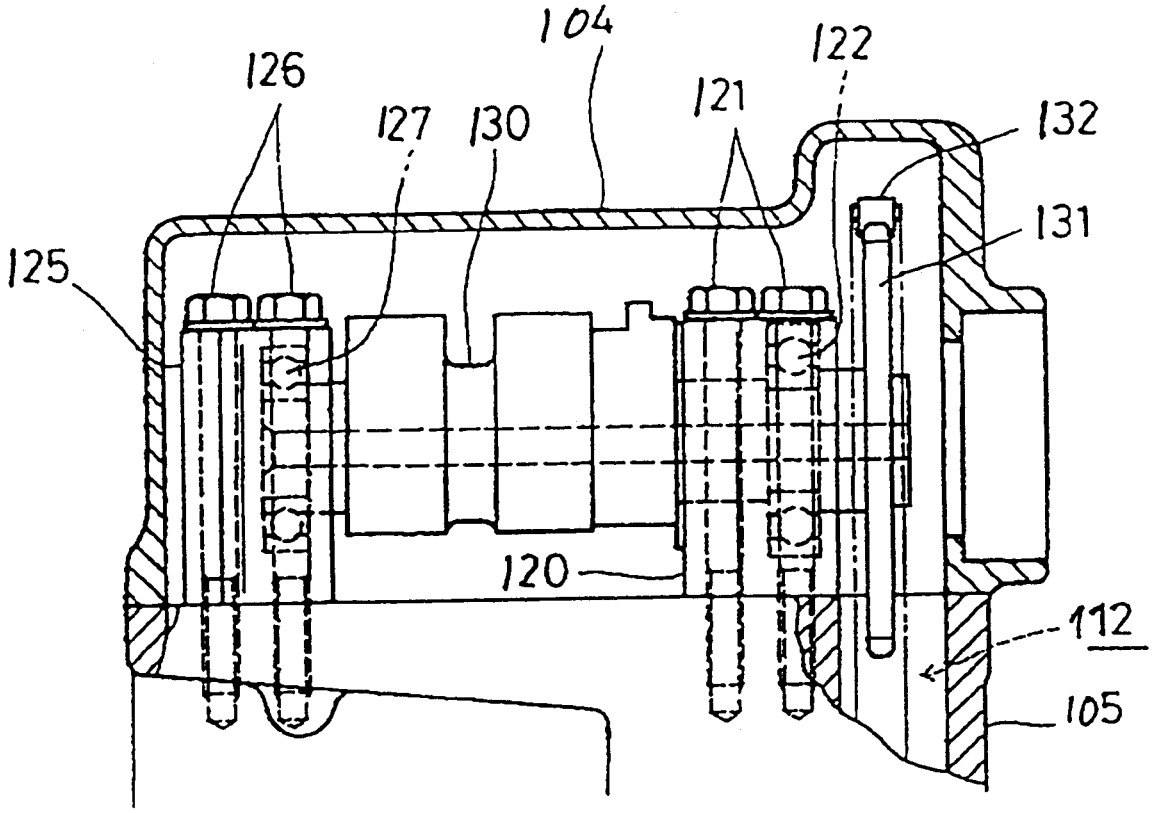
FIG. 6 is a side elevational view partially in section illustrating a mounting structure of a camshaft.

In the overhead valve type internal combustion engine 101 of this embodiment, a crank shaft 109 is horizontally mounted to a vehicle in a left and right direction of the vehicle body. FIG. 4 is a sectional view of the overhead valve type internal combustion engine 101 viewed from a left side. In FIG. 4, a connecting rod 108 connects a piston 107 which slidably moves within a cylinder sleeve 106 with a crank shaft 109 and converts the reciprocating motion of the piston 107 into the rotation of the crank shaft 109.

Figure 7:
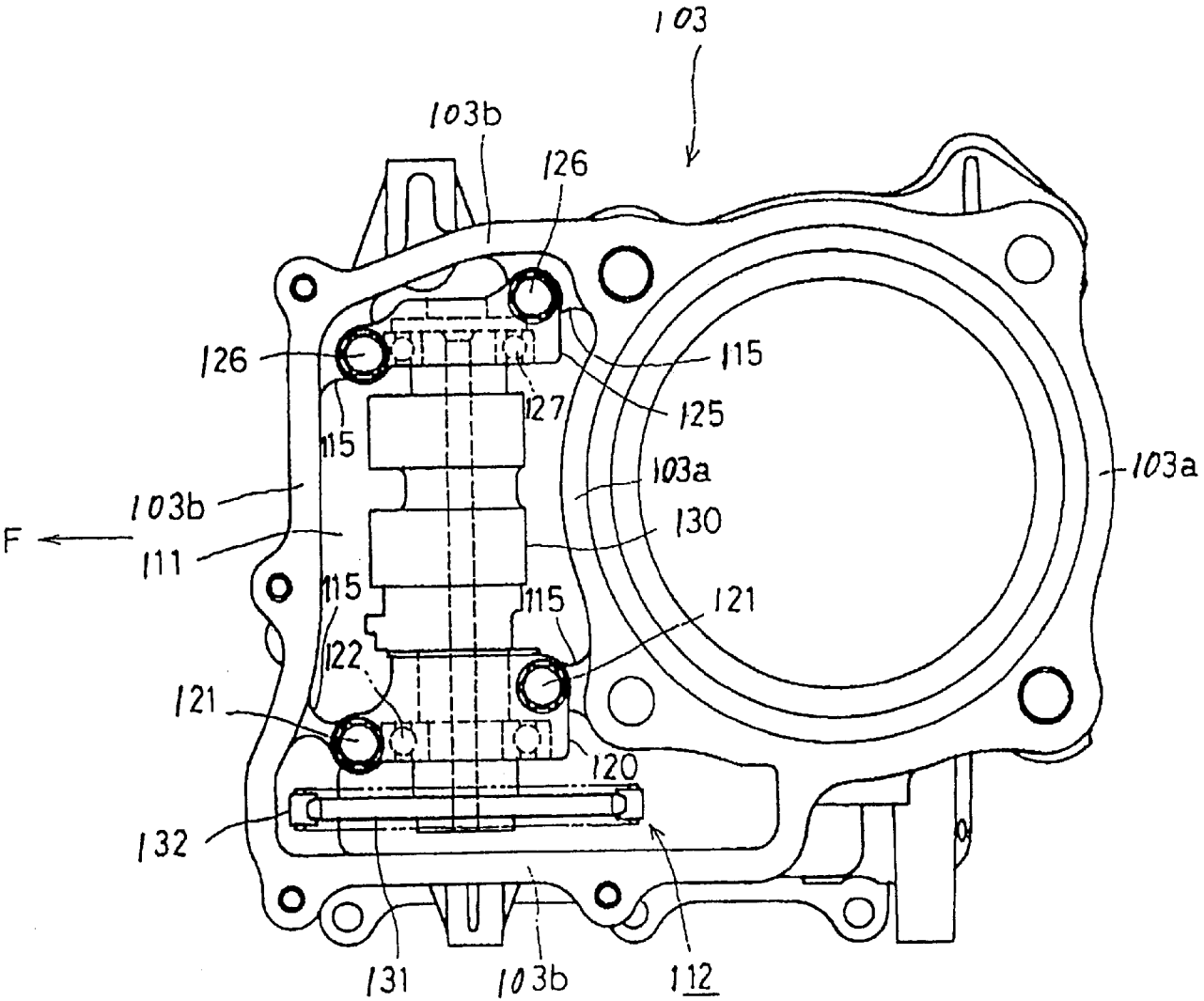
FIG. 7 is a top plan view illustrating a mounting, state of a camshaft on a cylinder deck surface of a cylinder block.
Figure 8:
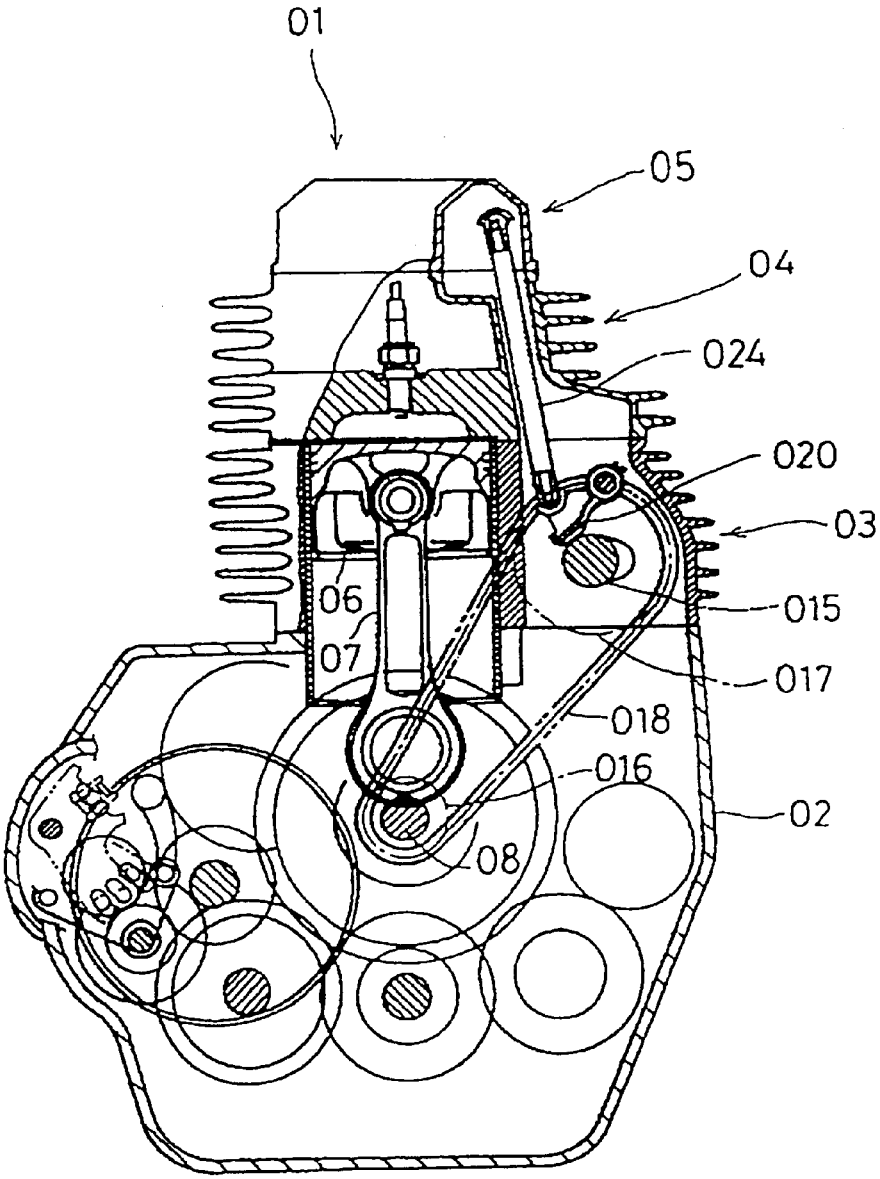
FIG. 8 BACKGROUND ART
FIG. 8 is a cross-sectional view illustrating an overhead valve type internal combustion engine of the related art.

An upper portion of the cylinder block 103 is swelled out forward from a cylinder bore. With reference to FIG. 7 which illustrates a plan view of a cylinder deck surface, it will be understood that a surface of the cylinder deck mated with a surface of the cylinder head 104 is composed of an annular shaped mating surface 103*a* having a circumference of the cylinder bore and a rectangular shaped mating surface 103*b* swelled out in a deformed channel shape.

Inside of a frame formed by a front portion of the annular mating surface 103*a* to a left portion thereof and a portion of the rectangular shaped mating surface 103*b*, there is a substantially L-shaped portion having a long-sized part in a lateral direction and a part extended rearward from a left end of the long-sized part. Furthermore, the long-sized part in the lateral direction is provided with a bottom wall 111 having a shallow depth and the pail extended from the left end forms a chain chamber 112 having an open bottom.

Furthermore, at the four corners of the bottom wall 111 in the lateral direction, four boss portions 115 are formed by swelling out vertices of roughly a parallelogram in plan view. Upper surfaces of the four boss portions 115 are substantially flush with the mating surfaces 103*a* and 103*b* and screw holes are formed at respective boss portions 115.

A camshaft holder 120 spans two front and rear boss portions 115 on the left side, and bolts 121 are threadedly engaged with and secured to the screw holes of the boss portions 115 by passing through circular holes at both ends of the camshaft holder 120.

Similarly, a camshaft holder 125 spans the two front and rear boss portions 115 on the right side, and bolts 126 are threadedly engaged with and secured to the screw holes of the boss portions 115 by passing through the circular holes at both ends of the camshaft holder 125.

The camshaft holder 120 on the left side has a bearing 122 fitted to an inside thereof. A camshaft 130 penetrates the bearing 122 at a left end thereof and is rotatably journalled by the bearing 122. The camshaft holder 125 on the right side has a bearing 127 fitted to an inside thereof The camshaft 130 penetrates the bearing 127 at a right end thereof and is rotatably journalled by the bearing 127.

FIG. 7 illustrates a state where the camshaft 30 is journalled by the camshaft holders 120 and 125 on the deck surface of the cylinder block 103.

Mounting positions of the bolts 121 and 126 for fixing the camshaft holders 120 and 125 on the deck surface of the cylinder block 103 are located at the vertices of the parallelogram. Furthermore, the mounting positions of a pair of the front side and rear side bolts of the respective camshaft holders 120 and 125 are offset in an axial direction of the camshaft 130.

Accordingly, in the mounting positions of the bolts for the pairs of the front sides and rear sides, the mounting positions of the front side bolts are located on the outer sides of the bearings 122 and 127, whereas the mounting positions of the rear side bolts are offset in an axial direction and located on the right sides of the bearing 122 and 127, hence coming closer to the camshaft 130.

Therefore, widths on the front and rear sides of the camshaft holders 120 and 125 are reduced, so that a length of the internal combustion engine 101 in the is front and rear direction is reduced.

As mentioned above, the camshaft holders 120 and 125 protrude from the deck surface of the cylinder block 103. Since the camshaft 130 is rotatably journalled to the camshaft holders 120 and 125 which protrude from the left and right sides, the camshaft 130 is located upward from the cylinder block 103 and positioned within the cylinder head 104.

A driven sprocket 131 is fitted and mounted in the left end of the camshaft 130. Furthermore, a cam chain 132 wound around the driven sprocket 131 is wound around a drive sprocket 133 fitted and mounted on the crank shaft 109 by passing through the chain chamber 112 (refer to FIG. 5).

The cam chain 132 is guided by a chain guide 134, and is provided with an appropriate tension by a chain tensioner 135.

In the cylinder head 104 which covers from above the camshaft holders 120 and 125 and the camshaft 130 protruding from the deck surface of the cylinder block 103, lifter guide portions are respectively formed corresponding to two cam lobes of the camshaft 130 and cam followers 140 are slidably fitted on respective lifter guide portions. The push rods 141 are connected, at their lower ends, with the cam followers 140.

The push rods 141 project into the cylinder cover 105 from within the cylinder head 104 and the upper ends thereof are connected with ends on one side of rocker arms 143 supported by a rocker arm shaft 142 to freely rock. The other ends of the rocker arms are connected with a suction valve 144 or an exhaust valve 145.

Accordingly, the rotation of the crank shaft 109 rotates the camshaft 130, which is located within the cylinder head 104, via the cam chain 132 and the rotation of the camshaft 130 moves the push rods 141 up and down. Therefore, the suction valve 144 and the exhaust valve 145 are driven at prescribed timings to open and close via the rocker arms 143.

In the overhead valve type inner combustion engine 101 as described above, since the camshaft 130 is journalled by the camshaft holders 120 and 125, which protrude from the deck surface of the cylinder block 103, and located within the cylinder head 104, a distance from the camshaft 130 to the rocker arms 143, which are disposed within the cylinder cover 105, can be reduced. Furthermore, the lengths of the push rods 141 are reduced to decrease inertial weights of the push rods 141, so that the application of the structure for high speed rotation can be made possible.

Furthermore, since the camshaft 130 protrudes from the deck surface of the cylinder block 103 when only the cylinder head 104 is removed, leaving the cylinder block 103 in place, the camshaft 130 and the driven sprocket 131 at the end portion of the camshaft 130 are exposed. Therefore, the cam chain 132 can be easily removed, so that maintenance such as the replacement of the cams is facilitated.

The invention being thus described, it will be obvious that the same may be varied in many ways. Such variations are not to be regarded as a departure from the spirit and scope of the invention, and all such modifications as would be obvious to one skilled in the ail are intended to be included within the scope of the following claims.

What is claimed is:

1. A water pump system for circulating cooling water in an internal combustion engine, comprising:

said water pump is connected to one end of a cam shaft for a valve system arranged in a cylinder head of the engine, said water pump being driven by the cam shaft; and a delivery port of the water pump extends near a cooling water supply port formed in the a side wall of a cylinder block of the engine, said cooling water supply port being connected to a cooling water passage formed in the cylinder block.

2. The water pump system for circulating cooling water in an internal combustion engine according to claim 1, further comprising:

said delivery port of the water pump extends to a position directly opposite to the cooling water supply port; and a connection pipe connects said delivery port directly to the cooling water supply port.

3. The water pump system for circulating cooling water in an internal combustion engine according to claim 2, further comprising:

an outside casing having a pump suction port formed therein; and an inside casing connected to the outside casing, said inside casing having said delivery port formed therein and said connection pipe connected thereto.

4. The water pump system for circulating cooling water in an internal combustion engine according to claim 3, further comprising an impeller located in a space formed by the outside and inside casings.

5. The water pump system for circulating cooling water in an internal combustion engine according to claim 3, said inside casing further comprising a cylindrical mounting portion, said cylindrical mounting portion being mountable in a circular hole formed in an annular projecting wall of the cylinder head of the engine.

6. A method of mounting a camshaft in an overhead valve type internal combustion engine, comprising the step of:

positioning and mounting said camshaft in a space surrounded by an upper portion of a cylinder and a cylinder head of the engine.

7. The method of mounting a camshaft in an engine according to claim 6, further comprising the step of positioning and mounting said camshaft at a position upward from a cylinder deck surface of the engine.

8. The method of mounting a camshaft in an engine according to claim 7, further comprising the step of positioning an opposed pair of mounting bolts of camshaft holders pivotally supporting said camshaft in an offset relationship with each other in an axial direction.

9. The method of mounting a camshaft in an engine according to claim 6, further comprising the step of positioning an opposed pair of mounting bolts of camshaft holders pivotally supporting said camshaft in an offset relationship with each other in an axial direction.

10. A mounting structure of a camshaft in an overhead valve type internal combustion engine, comprising:

said camshaft is mounted in a space surrounded by an upper portion of a cylinder and a cylinder head of the engine.

11. The mounting structure of a camshaft according to claim 10, wherein said camshaft is positioned and mounted at a position upward from a cylinder deck surface of the engine.

12. The mounting structure of a camshaft according to claim 11, wherein an opposed pair of mounting bolts of camshaft holders pivotally supporting said camshaft are positioned and mounted in an offset relationship with each other in an axial direction.

13. The mounting structure of a camshaft according to claim 10, wherein an opposed pair of mounting bolts of camshaft holders pivotally supporting said camshaft are positioned and mounted in an offset relationship with each other in an axial direction.

14. A method for circulating cooling water in an internal combustion engine, comprising the step of:

providing a water pump;

connecting said water pump to one end of a cam shaft for circulating cooling water in an internal combustion engine;

driving said water pump by said cam shaft;

providing a delivery port of the water pump system for circulating cooling water in an internal combustion engine; and connecting said cool water supply port to a cooling water passage formed in the cylinder block.

15. The method for circulating cooling water in an engine according to claim 14, further comprising the step of:

extending said delivery port of the water pump to a position directly opposite to the cooling water supply port; and connecting a connection pipe to said delivery port directly to the cooling water supply port.

16. The method for circulating cooling water in an engine according to claim 15, further comprising the step of:

providing an outside casing having a pump suction port formed therein; and providing an inside casing connected to the outside casing, said outside casing having said delivery port formed therein and said connection pipe connected thereto.

17. The method for circulating cooling water in an engine according to claim 16, further comprising the steps of:

providing an impeller located in a space formed by the outside and inside casings.

18. The method for circulating cooling water in an engine according to claim 16, further comprising the step of:

providing a cylindrical mounting portion; and mounting said cylindrical mounting portion in a circular hole formed in an annular projecting wall of the cylinder head of the engine.

* * * * *